United States Patent [19]

Kerr

[11] 4,452,238

[45] Jun. 5, 1984

[54] IN HANDLE DISPENSING DEVICE

[75] Inventor: Ronald R. Kerr, Ft. Collins, Colo.

[73] Assignee: Teledyne Industries, Inc.

[21] Appl. No.: 428,902

[22] Filed: Sep. 30, 1982

[51] Int. Cl.[3] ..... A61H 9/00

[52] U.S. Cl. ..... 128/66; 222/133; 222/321; 222/402.24

[58] Field of Search ..... 128/66, 62 A, 200.21; 604/131, 149, 150, 151, 181, 183, 257; 222/320, 321, 373, 380, 383, 401, 402.24, 402.15, 402.14, 402.1, 133, 206; 433/80, 88

[56] References Cited

U.S. PATENT DOCUMENTS

| | | | |
|---|---|---|---|
| 2,550,565 | 4/1951 | Hyser | 433/88 |
| 3,227,158 | 1/1966 | Mattingly | 128/66 |
| 3,496,933 | 2/1970 | Lloyd | 128/66 |
| 3,500,824 | 3/1970 | Gilbert | 128/62 A |
| 3,568,667 | 3/1971 | Krieger et al. | 128/66 |
| 3,570,525 | 3/1971 | Borsum et al. | 128/66 |
| 3,590,813 | 7/1971 | Roszyk | 128/66 |
| 3,612,045 | 10/1971 | Dudas et al. | 128/66 |
| 3,749,291 | 7/1973 | Prussin et al. | 222/402.24 |
| 3,851,643 | 12/1974 | Musy | 128/66 |
| 4,133,482 | 1/1979 | Moret | 128/66 |
| 4,302,186 | 11/1981 | Cammack et al. | 433/80 |

FOREIGN PATENT DOCUMENTS

| | | | |
|---|---|---|---|
| 1241195 | 7/1971 | United Kingdom | 222/402.24 |

*Primary Examiner*—John J. Wilson

*Attorney, Agent, or Firm*—Hugh H. Drake

[57] ABSTRACT

An oral hygiene apparatus produces a succession of water pulses at a predetermined pressure and those pulses are delivered to a handle shaped to be grasped by the human hand. An elongated nozzle projects outwardly from the handle, the shape of the handle permitting the water pulses to be directed against the teeth and gums of the user. A reservoir that forms part of the handle contains a liquid to be selectively dispensed along with the water pulses. The reservoir is coupled into communication with the flow path of the water pulses. A controllable valve selectively opens communication to enable the conveyance of the liquid into the flow path and in response to the receipt of the water pulses within the handle.

9 Claims, 6 Drawing Figures

IN HANDLE DISPENSING DEVICE

The present invention relates to oral hygiene apparatus. More particularly, it pertains to apparatus which permits the addition to a water stream of a further liquid or the like.

The oral hygiene art includes a number of approaches for applying a pulsating flow of water to the teeth and gums of the user. Representative of that prior-art are U.S. Pat. No. 3,227,158—Mattingly and U.S. Pat. No. 4,302,186—Cammack. Those approaches involve use of a unit which includes a pump that receives water and produces pulses which are outletted through a small nozzle against the surfaces of the teeth and gums.

In connection with the use of such apparatus, it also has been suggested that an added liquid, such as a breath freshener, be placed into a water reservoir that supplies the water being emitted. Other additives may also have been suggested. With that approach, however, the additive must flow from the reservoir through the incorporated pump assembly and the conduits involved. This can result in undesired contamination. Another disadvantage of that approach is that the additive, once placed into the reservoir along with the water, is conveyed into the user's mouth throughout the cleaning operation.

It is, accordingly, a general object of the present invention to provide a new and improved apparatus that overcomes deficiencies and shortcomings of the aforementioned approaches in the prior art.

It is another object of the present invention to provide new and improved apparatus that enables selective addition of a liquid.

A further object of the present invention is to provide a highly convenient manner of containing such an additive.

In accordance with the present invention, an oral hygiene apparatus includes means for producing a succession of water pulses at a preselected pressure. It has a handle shaped to permit its being grasped by the human hand and means for delivering the water pulses to the handle. An elongated nozzle projects outwardly from the handle, manipulation of the handle permitting the water pulses to be directed against the teeth and gums of the user. An associated reservoir contains a liquid to be selectively dispensed along with the water pulses. The reservoir is coupled in communication with the flow path of the water pulses from the delivering means into the nozzle. A controllable valve selectively opens the communication to enable the conveyance of the liquid into the flow path in response to the receipt of the water pulses within the handle.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements and in which:

Figure 1:
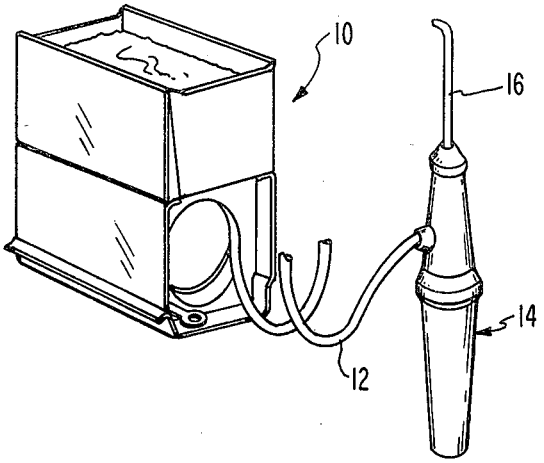
FIG. 1 is an isometric fragmentary view of an oral irrigating appliance of which feeds a handle through a flexible hose.
Figure 2:
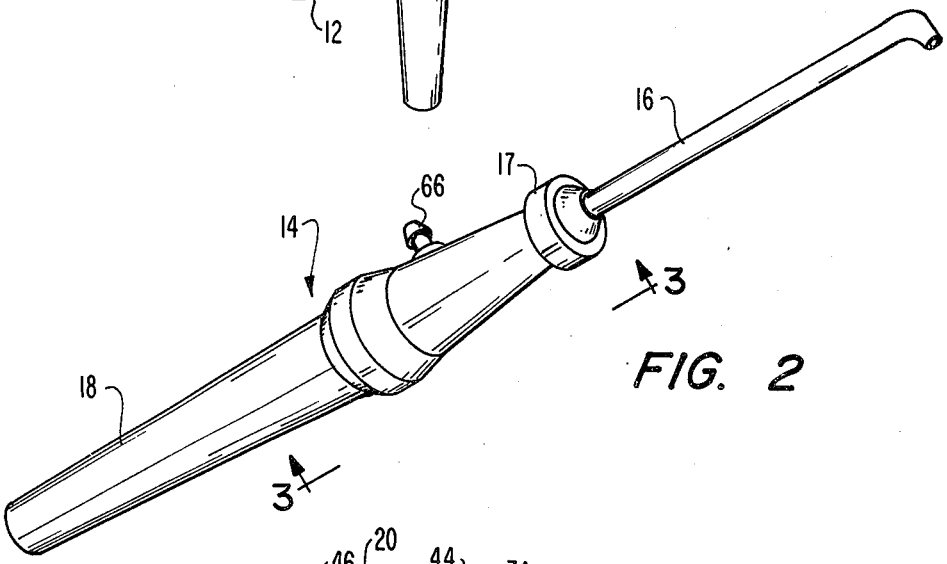
FIG. 2 is an enlarged isometric view of the handle.

An oral hygiene appliance 10 supplies successive water pulses at a preselected or predetermined pressure. Suitable versions of such an appliance are fully disclosed in U.S. Pat. No. 3,227,158—Mattingly and U.S. Pat. No. 4,302,186—Cammack. Accordingly, those patents are incorporated herein by reference for use of either of them as a source of a succession of water pulses.

A hose 12 leads from appliance 10 to a handle 14 which is shaped to permit its being grasped by the human hand. Projecting outwardly from handle 14 is an elongated nozzle 16 on which is disposed a finger knob 17. Manipulation of handle 14 permits the water pulses, flowing through the nozzle from the handle, to be directed against the teeth and gums of the user.

A reservoir 18 contains a liquid which is to be selectively dispensed along with the water pulses. The liquid contained in the reservoir may be any of a mouth freshener, sterilizer, medication, tooth whitener, plaque remover or decay inhibitor. Reservoir 18 is coupled into communication with the flow path of the water pulses received through hose 12 and conveyed into nozzle 16. Also included is a controllable valve unit 20 that selectively opens communication for the liquid in order to enable the conveyance thereof into the flow path of the water pulses in response to the receipt thereof within the handle.

While it might be an entirely separate part connected to handle 14 by a flexible hose or the like, reservoir 18 in this case is affixed to and becomes a part of handle 14 as shown. To that end, reservoir 18 is affixed to a portion 22 of handle 14 by means of a bayonet-threaded lock ring 24, a seal being formed by the interpositioning of a resilient O-ring 26.

Nozzle 16 is received within the nose portion 28 of handle 14 along a central channel 30. Defined in channel 30 is an annular groove 32 in which is seated a resilient O-ring 34 that mates with a corresponding circumferential groove 36 formed in the surface of nozzle 16.

Defined within handle portion 22 is a chamber 40 within which is disposed a valve 42. Valve 42 fits into a seat 44 and is resiliently urged thereagainst by a spring 46 captivated by a retainer 48.

The snout 50 of valve 42 protrudes into a cavity 52 formed in nose portion 28 of the handle and into which an end 53 of nozzle 16 also projects. The threaded portions indicated at 54 and 55 enable appropriate assembly of the overall parts that make up the totality of handle 14.

Disposed within cavity 52 is a free-floating actuator 56. Actuator 56 includes a yoke 58 into which the inner end 53 of nozzle 16 is received. Yoke 58 terminates in a cylinder 62 that connects to a base 64 the central portion of which faces valve stem snout 50. Hose 12 is connected to a fitting 66 formed into the sidewall of nose portion 28 and which communicates with the interior defined by cavity 52.

Fitting 66 is located about even with base 64. Flutes 68, spaced circumferentially about the periphery of base 64, allow presssure pulses of the water to urge yoke 58 into the position in which valve 42 is allowed to be closed. In that state of operation, water also flows through circumferentially spaced apertures 70 in cylinder 62 and on through nozzel 16. A portion of the inletted water also may flow into nozzle 16 by way of a pair of openings 72 through base 64.

When actuator 56 is urged in the direction to open valve 42, it abuts an annulus 74 or other stop that projects toward valve 42. Openings 72 serve to admit the pressure pulses of water into reservoir 18 under that condition. With tight tolerences in manufacture, either flutes 68 or openings 72 might be unnecessary, or a central passage could replace openings 72 and annulus 74. The illustrated embodiment has been preferred, because it appears to allow operation with but very little criticality on parameters. Cylinder 62 may be in the form of circumferentially-spaced legs that establish apertures 70, and base 64 could be formed as a spider.

In use, the flow path from fitting 66 through cavity 52 permits normal delivery of the water pulses through nozzle 16 to the teeth or gums of the user in a manner the same as described in the cross-referenced patents. When, however, the user desires to add a portion of the liquid contained within reservoir 18, it is only necessary to move nozzle 16 longitudinally a slight distance in order to urge actuator 56 against the end 50 of valve 42 and thereby open that valve. When valve 42 is so opened, the positive pressure developed upon receipt of each water pulse within the handle serves to pressurize reservoir 18. In turn, that allows conveyance of the liquid within reservoir 18 into the flow path of the water pulses during each interval between the receipt of each of the water pulses. It is to be noted that "liquid" refers to that which is delivered from reservoir 18. The material initially disposed in the reservoir might be a readily-soluble powder or the like.

In practice, it has been found that the amount of throw or displacement of actuator 56 need be only extremely small, of the order of 0.003–.005 inch. This amount of movement is obtainable even though nozzle 16 remains seated upon O-ring 34. When using the apparatus, therefore, the user need only very slightly joggle nozzle 16 in a longitudinal direction in order to obtain the additive. For example, the user might desire to have a breath freshener inserted both at the beginning and at the end of the oral irrigation process. Using some kind of medication, on the other hand, it might be desirable to add the liquid from reservoir 18 only at the end of the procedure. In any case, the selected control arrangement that involves actuator 56 and valve 42 conserves the liquid contained within reservoir 18 by allowing its entry only on demand during but a part of the total period of use of the apparatus for irrigation.

Figure 3:
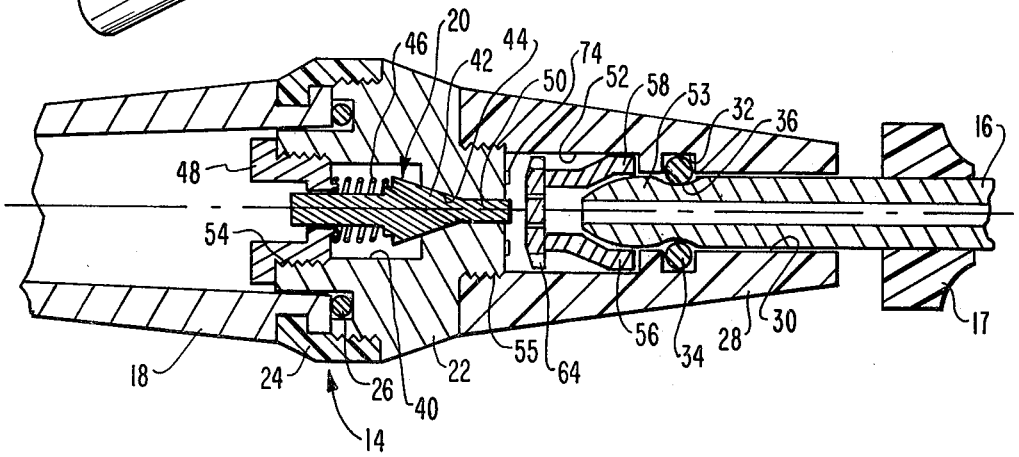
FIG. 3 is an enlarged fragmentary view taken from the viewpoint of the line 3—3 in FIG. 2 but along the longitudinal axis.
Figure 4:
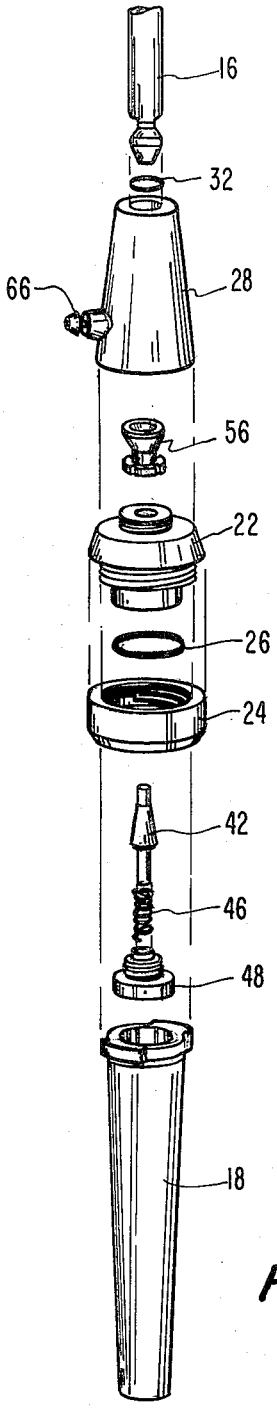
FIG. 4 is an exploded fragmentary isometric view of the handle.
Figure 5:
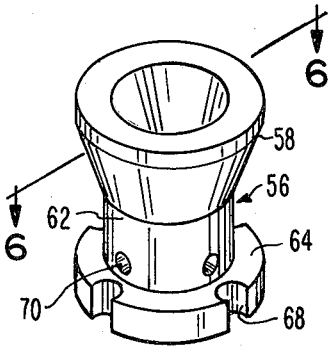
FIG. 5 is an enlarged isometric view of a component shown in FIGS. 3 and 4.
Figure 6:
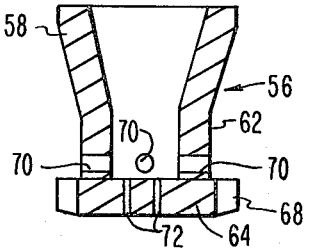
FIG. 6 is a cross-sectional view taken along the line 6—6 in FIG. 5.

As indicated in FIG. 3, reservoir 18 is a rigid-walled container that forms a part of handle 14. When valve 20 is forced into an open position, a portion of the pulses of the incoming water is inletted into the interior of reservoir 18 and thereby serves as a pressurizing means that permits the pressurized contents of the reservoir to leave between successive pulses of the incoming water. In itself, reservoir 18 not only forms a part of the handle but contributes to the capability of the overall handle being capable of being grasped by the user's hand.

Of course, other modes of delivering the liquid from reservoir 18 might be substituted. That could include the use of Venturi-effect to draw the liquid from the reservoir. However, the metering volume encountered is so small that that does not seem, at this point, to be practical.

While a particular embodiment of the invention has been shown and described, and alternatives have been mentioned, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. Oral hygiene apparatus comprising:
means for producing a sucession of water pulses at a preselected pressure;
a handle shaped to permit being grasped by the human hand;
means for delivering said water pulses from said producing means into said handle;
an elongated nozzle projecting outwardly from said handle, manipulation of said handle permitting said water pulses, flowing through said nozzle from said handle, to be directed against the teeth and gums of the user;
a reservoir for containing a liquid to be selectively dispensed along with said water pulses;
means for coupling said reservoir into communication with the flow path of said water pulses from said delivering means into said nozzle;
means including a controllable valve for selectively opening said communication to enable the conveyance of said liquid into said flow path in response to the receipt of said water pulses within said handle;
and said reservoir being a rigid-walled container.

2. Apparatus as defined in claim 1 in which said valve, when open, admits a portion of pulses of said water into the interior of said reservoir as a pressurizing means and permits the pressurized contents of said reservoir to leave said reservoir between said pulses.

3. Apparatus as defined in claim 1 in which said reservoir is included in and forms a part of said handle exposed to be grasped by the user.

4. Oral hygiene apparatus comprising:
means for producing a succession of water pulses at a preselected pressure;
a handle shaped to permit being grasped by the human hand;
means for delivering said water pulses from said producing means into said handle;
an elongated nozzle projecting outwardly from said handle, manipulation of said handle permitting said water pulses, flowing through said nozzle from said handle, to be directed against the teeth and gums of the user;
a reservoir for containing a liquid to be selectively dispensed along with said water pulses;
means for coupling said reservoir into communication with the flow path of said water pulses from said delivering means into said nozzle;
means including a controllable valve for selectively opening said communication to enable the conveyance of said liquid into said flow path in response to the receipt of said water pulses within said handle;
said nozzle being seated within said handle by a seal which resiliently resists longitudenal movement of said nozzle;
and means for enabling the opening and closing of said valve in response to longitudenal movement of said nozzle in an amount insufficient to unseat said nozzle from said seal.

5. Apparatus as defined in claim 4 in which said enabling means includes an actuator movable within said housing in a direction away from said valve in response to receipt of said pulses but movable in response to longitudenal movement of said nozzle to open said valve.

6. Apparatus as defined in claim 5 in which said actuator is shaped to seat upon the inner portion of said nozzle.

7. Oral hygiene apparatus comprising:

means for producing a succession of water pulses at a preselected pressure;

a handle shaped to permit being grasped by the human hand;

means for delivering said water pulses from said producing means into said handle;

an elongated nozzle projecting outwardly from said handle, manipulation of said handle permitting said water pulses, flowing through said nozzle from said handle, to be directed against the teeth and gums of the user;

a reservoir for containing a liquid to be selectively dispensed along with said water pulses;

means for coupling said reservoir into communication with the flow path of said water pulses from said delivering means into said nozzle;

means including a controllable valve for selectively opening said communication to enable the conveyance of said liquid into said flow path in response to the receipt of said water pulses within said handle;

and said valve,when open, admitting a portion of pulses of said water into the interior of said reservoir as a pressurizing means and permitting the pressurized contents of said reservoir to leave said reservoir between said pulses.

8. Apparatus as defined in claim 7 in which said valve is resiliently urged toward into a normally closed position.

9. Apparatus as defined in claim 7 in which said valve is disposed in a cavity in which said water and said liquid are mixed during the absence of said pulses.

* * * * *